US008424650B2

(12) United States Patent
Brand

(10) Patent No.: US 8,424,650 B2
(45) Date of Patent: Apr. 23, 2013

(54) MOTION PLANNING FOR ELEVATOR CARS MOVING INDEPENDENTLY IN ONE ELEVATOR SHAFT

(75) Inventor: Matthew Brand, Newton, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 363 days.

(21) Appl. No.: 12/948,035

(22) Filed: Nov. 17, 2010

(65) Prior Publication Data

US 2012/0118672 A1 May 17, 2012

(51) Int. Cl.
*B66B 9/00* (2006.01)

(52) U.S. Cl.
USPC ..... 187/249; 187/380

(58) Field of Classification Search ..... 187/247, 187/249, 380–388, 391, 393
See application file for complete search history.

(56) References Cited

U.S. PATENT DOCUMENTS 5,823,299 A * 10/1998 Wierschke et al. ..... 187/277
5,865,274 A * 2/1999 Kiji et al. ..... 187/380
6,360,849 B1 * 3/2002 Hikita ..... 187/381
6,364,065 B1 * 4/2002 Hikita ..... 187/382
6,619,437 B2 * 9/2003 Hikita ..... 187/383
6,871,727 B2 * 3/2005 Jokela et al. ..... 187/383
6,955,245 B2 * 10/2005 Dunser et al. ..... 187/382
7,198,136 B2 * 4/2007 Urata ..... 187/383
7,621,376 B2 * 11/2009 Duenser et al. ..... 187/249
8,132,652 B2 * 3/2012 Hakala et al. ..... 187/249
8,297,409 B2 * 10/2012 Hsu et al. ..... 187/249
2010/0065378 A1 3/2010 Christy et al.
2010/0213012 A1 8/2010 Wang et al.
2012/0118672 A1 * 5/2012 Brand ..... 187/247
2012/0193170 A1 * 8/2012 Jacobs ..... 187/249

* cited by examiner

*Primary Examiner* — Anthony Salata
(74) *Attorney, Agent, or Firm* — Gene Vinokur; Dirk Brinkman

(57) ABSTRACT

A method for controlling a motion of a first car and a second car in a multi-car elevator system, wherein the first car and the second car move independently in an elevator shaft, determines alternately motion plans for the first the second cars wherein each part of a motion plan for the first car is determined for a planning period of the first car, wherein a beginning of the planning period of the first car is determined by an end of the planning period of the second car, and an end of the planning period of the first car is determined by a home position of the first car on the motion plan, wherein the part of the motion plan is determined based on motion constraints, a set of requests, and the motion plan of the second car determined by the beginning of the planning period of the first car.

20 Claims, 8 Drawing Sheets

300

Until planning horizon is reached:

1. Select the first car as an elevator car whose motion plan ends first.
2. Plan motion of the first car away from home position with stops for passengers.
3. If the first car enters a deadlock zone of the second car wait at most recent stop of the first car
3A. If the second car is empty, change the motion plan of the second car, such that the second car is moved out of the way of the first car
4. Plan the motion of the first car toward the home position with stops for passengers.
5. Stop planning for the first car at the home position.
6. Announce that the motion until the home position is planed
7. Optionally, collect statistics on system performance
8. Repeat from step 1, wherein the second car is the first car.

FIG. 5

MOTION PLANNING FOR ELEVATOR CARS MOVING INDEPENDENTLY IN ONE ELEVATOR SHAFT

RELATED APPLICATION

This Patent Application is related to U.S. patent application Ser. No. 12/948,057, "Motion planning for elevator cars moving independently in one elevator shaft" filed by Brand, on Nov. 17, 2010, and incorporated herein by reference.

FIELD OF THE INVENTION

This invention relates generally to a multi-cars elevator system and more particularly to motion planning for the multi-cars elevator system.

BACKGROUND OF THE INVENTION

Motion planning for a conventional single-car elevator system, in which one car moves in one elevator shaft, is relatively simple. The elevator car services all requests in a current direction, then reverses and does the same again. However, in some elevator systems, multiple elevator cars move within one elevator shaft. Such systems reduce the number of elevator shafts, and increase the passenger capacity of the elevator systems.

Motion planning for the elevators cars moving in one shaft must prevent collision of the cars. One solution to the collision problem is to move both cars at the same time and in the same direction. Typically, such a solution is implemented in a "double-deck" elevator by arranging one elevator car on top of the other. The double-deck elevator allows passengers on two consecutive floors to use the elevator simultaneously, and significantly increase the passenger capacity of the elevator system. However, the double-deck elevator is only efficient in a building where the volume of traffic normally causes a single elevator to stop at every floor.

Another solution to the collision problem is to designate separate segments of the shaft for each elevator car. However, that approach restricts the flexibility of movement of each elevator car, and thus inefficient. At present, there is not enough computing power in real-time systems to search the space of all motion plans for large group elevator installations.

Accordingly, it is desired to provide a motion planning method for an elevator system that has multiple cars moving independently in one elevator shaft, while eliminating a possibility of collision.

SUMMARY OF THE INVENTION

It is an object of the invention to provide a method for planning motion of multiple elevator cars moving independently in one elevator shaft.

It is further object of the invention to provide such a method that prevents collision of the elevator cars.

It is further object of the invention to provide such a method for the motion planning that eliminate undesirable motion of the elevator cars., such as a sudden reversal, in which a non-empty car reverses to make room for the other car, a dead wait, in which a car makes unscheduled stops without opening doors, or a gratuitous stop, which is essentially a dead wait with doors opened to avoid passenger panic.

Embodiments of the invention are based on a realization that the motion plans for each elevator car can be determined deterministically in dependence given knowledge of the motion plans of the other elevator cars. More over, each car, e.g., a lower car and an upper car, in multi-cars elevator system determines motion plans alternately for their respective planning periods. In multi-cars elevator system that employs principles of the invention, the cars in a shaft take turns extending their motion plans further into the future.

The beginning of the planning period for each elevator cars is determined by an end of the planning period of the other car. The end of the planning period of each elevator car is determined in accordance with their respective home positions.

In multi-cars elevator system that employs principles of the invention, the elevator cars plan their motion in turns, i.e., alternately, each car has a fair share of the planning time, and each car considers the motion plans of the other car determined before the beginning of the planning period of the car.

For example, in a double-cars elevator system, planning alternates between the lower car and the upper car, each extending its respective motion plans until the cumulative motion plans reach a planning horizon, usually the point in the future where all known passengers have been serviced.

In one embodiment of the invention, the home positions of the cars are determined in accordance with a configuration of a building, in which the multi-car elevator system is installed and/or an expected traffic pattern. In another embodiment, the home positions of the cars are their respective farthest positions. For example, for a lower car, the farthest position is a lobby. For an upper car, the farthest position is the top floor of the building.

In yet another embodiment, the home position is the last stop in the current schedule of stops of the elevator cars nearest to their respective farthest positions. For example, the lower car is at the home position at the bottom floor of its current schedule of stops, e.g., the lobby. Similarly, the upper car is at the home position at the top floor of its current schedule of stops.

Assigning the home position based on last stop has an additional advantage. In the home position, the car is considered to be "empty" and some motion constrains allows to move the car along the current direction before the last stop to clear the way for another car.

Accordingly, one embodiment of invention discloses a method for controlling a motion of a first car and a second car in a multi-car elevator system, wherein the first car and the second car move independently in an elevator shaft, comprising the steps of determining alternately motion plans for the first car and the second car wherein each part of a motion plan for the first car is determined for a planning period of the first car, wherein a beginning of the planning period of the first car is determined by an end of the planning period of the second car, and an end of the planning period of the first car is determined by a home position of the first car on the motion plan, wherein the part of the motion plan is determined based on motion constraints, a set of requests, and the motion plan of the second car determined by the beginning of the planning period of the first car; and generating a command to control the motion of the elevator cars based on the motion plans.

Another embodiment discloses a method for controlling a motion of elevator cars in a multi-car elevator system, the elevators cars includes a first car and a second car, wherein the elevator cars move independently in an elevator shaft, comprising the steps of: determining, upon receiving a motion plan of the second car until a home position of the second car, a part of a motion plan of the first car from a last scheduled position of the first car till a home position of the first car, wherein the determining is based on motion constraints, a set of requests, and the motion plan of the second car; and generating a command to control the motion of the first car based on the motion plan of the first car.

And yet another embodiment discloses a control system for controlling an operation of a multi-cars elevator system, wherein a first car and a second car move independently in an elevator shaft of the elevator system, comprising:

a first planning period module for determining a planning period for the first car; a second planning period module for determining a planning period for the second car; a first motion planning module for determining a motion plan for the planning period of the first car; a second motion planning module for determining a motion plan for the planning period of the second car, wherein a beginning of the planning period of respectively the first car and the second car is determined by an end of the planning period of respectively the second car and the first car, and an end of the planning period of respectively the first car and the second car is determined by a home position of respectively the first car and the second car on respective motion plans, wherein the respective motion plans are determined based on motion constraints, a set of requests, and the motion plans determined before the planning period of the first car and the planning period of the second car; and an operation control module for generating a command to control motion of the first car and the second car based on the respective motion plans.

Definitions

In describing embodiments of the invention, the following definitions are applicable throughout (including above).

A "computer" refers to any apparatus that is capable of accepting a structured input, processing the structured input according to prescribed rules, and producing results of the processing as output. Examples of a computer include a computer; a general-purpose computer; a supercomputer; a mainframe; a super mini-computer; a mini-computer; a workstation; a microcomputer; a server; an interactive television; a hybrid combination of a computer and an interactive television; and application-specific hardware to emulate a computer and/or software. A computer can have a single processor or multiple processors, which can operate in parallel and/or not in parallel. A computer also refers to two or more computers connected together via a network for transmitting or receiving information between the computers. An example of such a computer includes a distributed computer system for processing information via computers linked by a network.

A "central processing unit (CPU)" or a "processor" refers to a computer or a component of a computer that reads and executes software instructions.

A "memory" or a "computer-readable medium" refers to any storage for storing data accessible by a computer. Examples include a magnetic hard disk; a floppy disk; an optical disk, like a CD-ROM or a DVD; a magnetic tape; a memory chip; and a carrier wave used to carry computer-readable electronic data, such as those used in transmitting and receiving e-mail or in accessing a network, and a computer memory, e.g., random-access memory (RAM).

"Software" refers to prescribed rules to operate a computer. Examples of software include software; code segments; instructions; computer programs; and programmed logic. Software of intelligent systems may be capable of self-learning.

A "module" or a "unit" refers to a basic component in a computer that performs a task or part of a task. It can be implemented by either software or hardware.

A "control system" refers to a device or a set of devices to manage, command, direct or regulate the behavior of other devices or systems. The control system can be implemented by either software or hardware, and can include one or several modules. The control system, including feedback loops, can be implemented using a microprocessor. The control system can be an embedded system.

A "computer system" refers to a system having a computer, where the computer comprises computer-readable medium embodying software to operate the computer.

A "network" refers to a number of computers and associated devices that are connected by communication facilities. A network involves permanent connections such as cables, temporary connections such as those made through telephone or other communication links, and/or wireless connections. Examples of a network include an internet, such as the Internet; an intranet; a local area network (LAN); a wide area network (WAN); and a combination of networks, such as an internet and an intranet.

BRIEF DESCRIPTION OF THE DRAWINGS

FIG. 5 is a pseudo-code for one embodiment of the invention;

DETAILED DESCRIPTION OF THE PREFERRED EMBODIMENT

Figure 1:
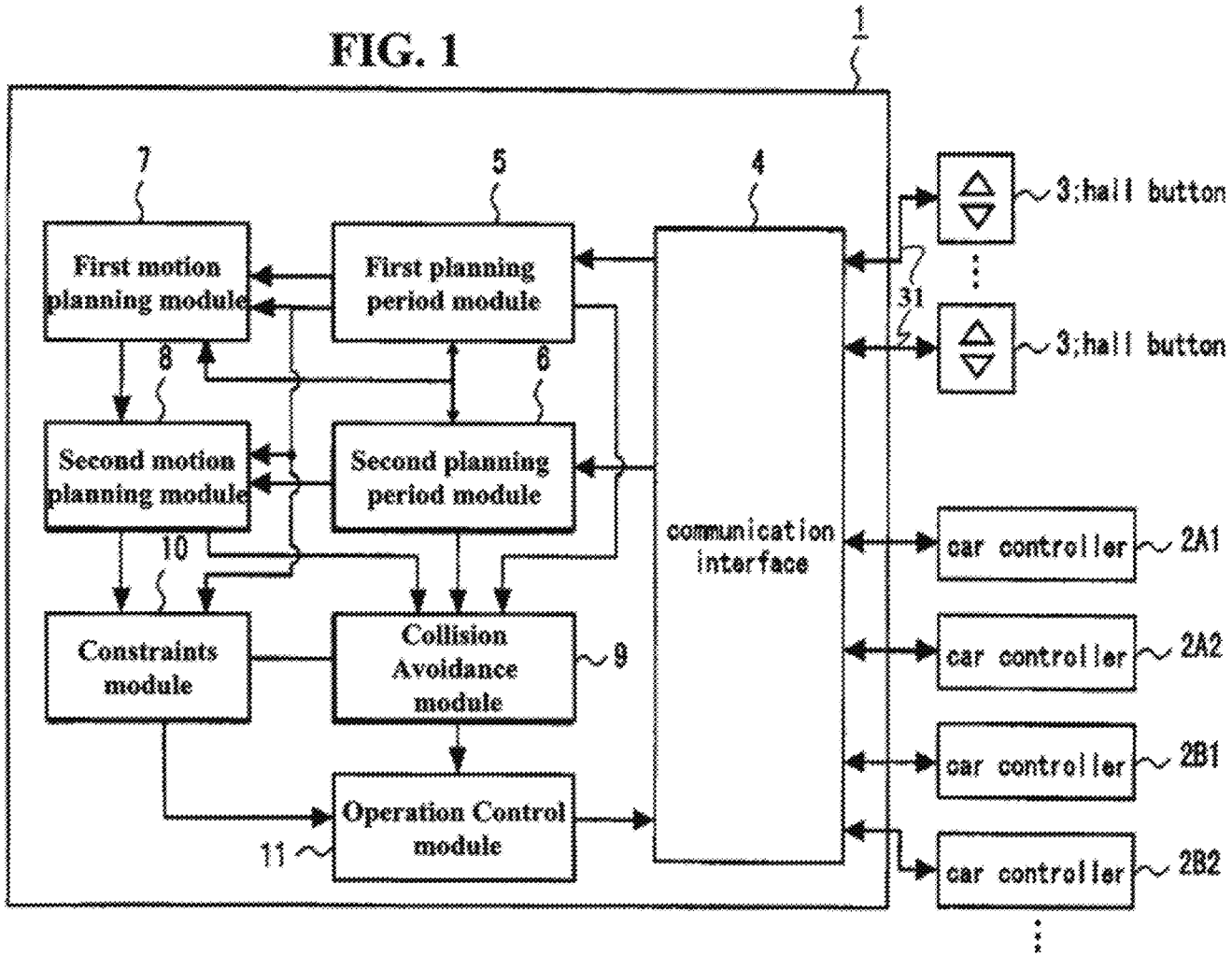
FIG. 1 is a block diagram of an elevator control system according to embodiments of the invention.
Figure 2:
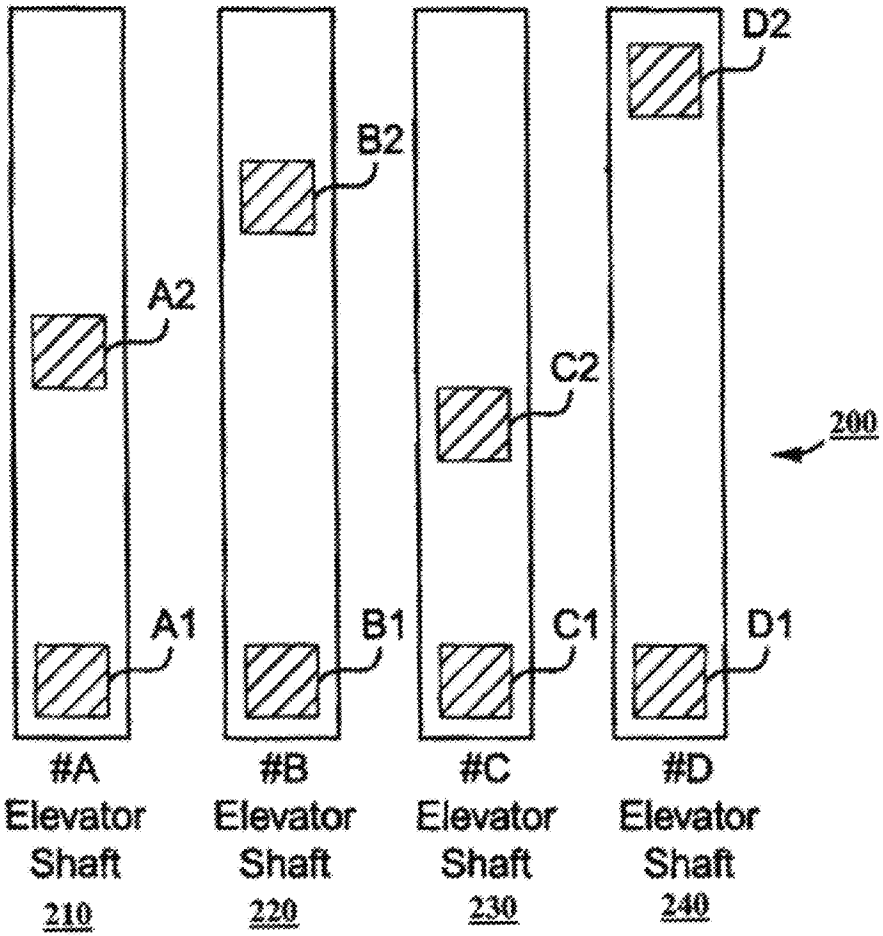
FIG. 2 is a schematic of an arrangement of multiple elevator cars within respective elevator shafts.

FIG. 1 shows an elevator control system 100 for a multi-cars elevator system 200 as shown in FIG. 2. Referring to FIG. 2, the multi-cars elevator system 200 includes a set of shafts 210-240, referred herein as shafts #A to #D.

At least one shaft in the multi-cars elevator system includes at least two elevators car, e.g., a first car and a second car, moving independently in the shaft. In one embodiment, all shafts include multiple elevator cars.

For example, the elevator shaft #A has elevator cars A1 and A2 for moving in the shaft, wherein A1 represents a lower car and A2 represents an upper car. Similarly, the elevator shaft #B has elevator cars B2 and B2, wherein B1 represents a lower car and B2 represents an upper car. The elevator shaft #C has elevator cars C1 and C2, wherein C1 represents a lower car and C2 represents an upper car. The elevator shaft #D has elevator cars D1 and D2, wherein D1 represents a lower car and D2 represents an upper car. Although FIG. 2 shows an example relating to four elevator shafts #A to #D, each of which includes two elevator cars, the number of elevator shafts and the number of cars are not limited to this example.

As shown in FIG. 1, the control system 100 includes a controller 2A1 for controlling a motion of the lower car A1 moving in the elevator shaft #A, a controller 2A2 for controlling a motion of the upper car A2 in the shaft #A, a controller 2B1 for controlling a motion of the lower car B1 in the elevator shaft #B, and a controller 2B2 for controlling a motion of the upper car B2 in the shaft #B. Similarly, the control system includes other controllers 2C1 to 2D2 for controlling motions of the elevator cars of the elevator shafts C and D. Those controllers are omitted from FIG. 1 for clarity.

A communications interface 4 communicates data between hall buttons 3 and each of the controllers 2A1 to 2D2. The hall buttons are input devices for receiving a set of requests 31 from passengers using the elevator system. The hall buttons are typically arranged near the entrances to the elevator car at each floor.

A first planning period module 5 determines a planning period for a first car, e.g., the lower car A1. Similarly, a second planning period module 6 determines a planning period for a second car, e.g., the upper car A2. The planning modules determine the planning period of their respective elevators cars based on the requests received from the communication interface, and planning periods of other elevators cars. As described in more details below, the beginning of the planning period for each elevator car is determined by an end of the planning period of the other car. The end of the planning period of each elevator car is determined in accordance with their respective predetermined home positions.

A first motion planning module 7 and a second motion planning module 8 determine motion plans, i.e., a schedule of stops, for the first and the second cars, respectively. The motion plans are determined for the planning periods of each elevator car based on the set of requests, motion plans of another elevator car determined before the beginning of the planning period of the elevator car and motion constrains provided by a constraints module 10. The motion plans are used by an operation control module 11 for generating a command to the controllers to control the motion of the elevator cars based on the motion plans.

In one embodiment, an optional collision avoidance module 9 determines a safety zone to avoid collision of the elevator cars. This module account for a fact that even if the motions of elevator cars are planed to avoid the collisions, a possibility of collision can occur if the motion plans of the elevator cars are altered by unforeseen events. For example, the motion plans are altered if a passenger holds the doors of an elevator car open for unspecified period of time. Consequently, the collision avoidance module is designed to prevent collisions.

Figure 3:
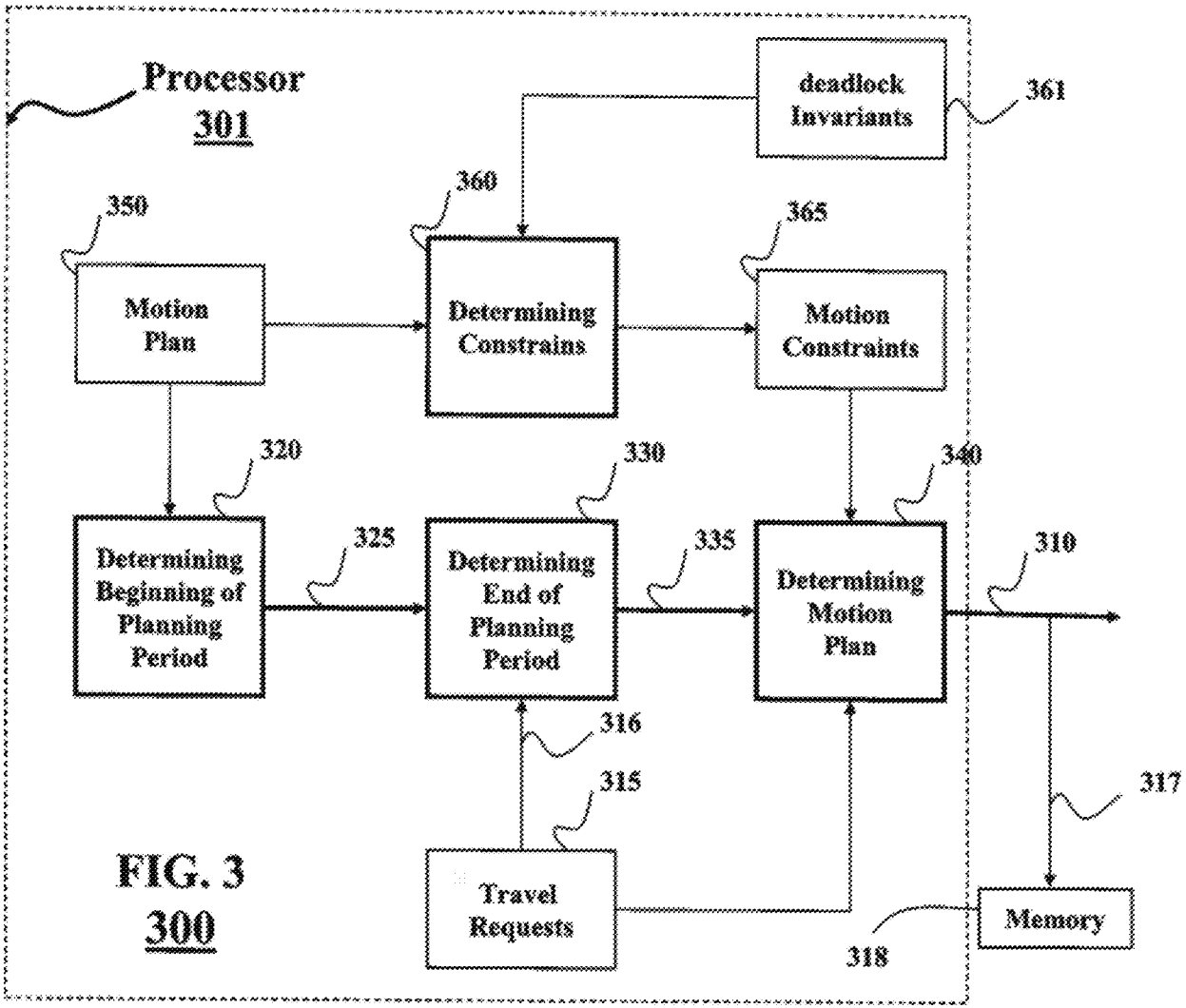
FIG. 3 is a flowchart of a method for determining motion plans of the elevator cars according embodiments of the invention.

FIG. 3 shows a method 300 for determining motion plans for the elevator cars in the multi-cars elevator system. The motion plans are determined alternately for each elevator cars, e.g., the first car and the second car. Each part of the motion plan for the first car is determined during a planning period of the first car, wherein a beginning of the planning period of the first car is determined by an end of the planning period of the second car, and an end of the planning period of the first car is determined by a home position of the first car on the motion plan, wherein the part of the motion plan is determined based on movement constraints, a set of requests, and the motion plan of the second car determined by the beginning of the planning period of the first car.

FIG. 3 shows a determining of the part 310 of the motion plan for one elevator car, e.g., the first car. However, the determination of the motion plan for another car, e.g., the second car is identical to the method 300. The method 300 is implemented using a processor 301, as known in the art.

The beginning of the planning period of the first car is determined 320 based on the end of the planning period of the second car, which is indicated by the motion plan 350 of the second car. For example, in one embodiment, the beginning of the planning period 325 is determined based on and/or upon receiving the motion plan of the second car. In another embodiment, a time instant of the beginning of the planning period 325 is received from the second planning period module.

The part 310 of the motion plan is determined from a last scheduled position until a home position of the first car. The home position 316 of the first car varies among embodiments and is determined based on the set of requests 315, as described below. The last scheduled position 317 corresponds to the home position determined in a previous execution of the method 300 and is retrieved from a memory 318 for a current execution of the method 300. The end of the planning period 335 is determined 330 based on the home position 316.

In one embodiment of the invention, the home positions of the cars are assigned randomly or predetermined in accordance with a scheme of a building, in which the multi-car elevator system operate and/or an expected traffic pattern. In another embodiment, the home positions of the cars are their respective farthest positions. For example, for a lower car, the farthest position is a lobby. For an upper car, the farthest position is the top floor of the building.

In yet another embodiment, the home position is the last stop in the current schedule of stops of the elevator cars closest to their respective farthest positions. For example, the lower car is at the home position at the bottom floor of its current schedule of stops, which is still usually the lobby. Similarly, the upper car is at the home position at the top floor of its current schedule of stops.

Assigning the home position based on last stop has an additional advantage. In that position, the car is considered assumed to be empty, and some motion plan constrains allow pushing the car along the direction of the motion before the last stop to clear the way for another car.

A deadlock is a situation where the lower car is carrying a passenger whose destination is at or above the upper car, and the upper car is carrying a passenger whose destination is at or below the lower car. A deadlock can only be resolved by reversing the motion of one car, which is undesirable for the passengers. The embodiments of the invention ensure that no deadlocks are introduced into the motion plans by preserving deadlock invariants 361.

The motion plan 350 and the deadlock invariants 361 are used for determining 360 constraints 365 of the motion plan. The motion constraints regulate possible schedules of stops of the first car. The motion constraints insure that the first car is outside of a deadlock zone of the second car, and a minimum distance is maintained between the cars. In various embodiments, the deadlock zone of the second car is determined based on the motion plan of the second car. For example, in one embodiment, the deadlock zone is all floors in a current direction of the motion of the second car. In another embodiment the deadlock is limited by the schedule of actual stops of the second car.

In various embodiments, if the schedule of stops of the second car is known, then the first car does not enter the deadlock zone of the second car and waits, e.g., at a last stop outside the deadlock zone of the second car, until scheduled home-ward motion of the second car makes the motion of the first car safe to move to the next stop. Similarly if the first car is following the second car and can reach and collide with the second car, the motion constrains make the motion of the first car to be slowed, usually by pausing the first car at its most recent stop.

Additionally or alternatively, the deadlock invariants define that the first car can be in the deadlock zone of the second car, if either first or the second car is empty, or both cars are moving in the same direction. In another embodiment, the first car can enter the deadlock zone of the second car, if the motion plan of the second car ensures that the first car leaves the deadlock zone of the second car timely to avoid collision.

Based on the motion constraints and the set of request from the passengers, the path 310 from the last scheduled position till the home position of the first car is determined 340. After the part of the motion plan is determined, the motion plan is communicated to the modules responsible for determining the motion plans of the second car, and the part 310 is the motion plan 350 for determining the motion plans of the second car.

Figure 4A:
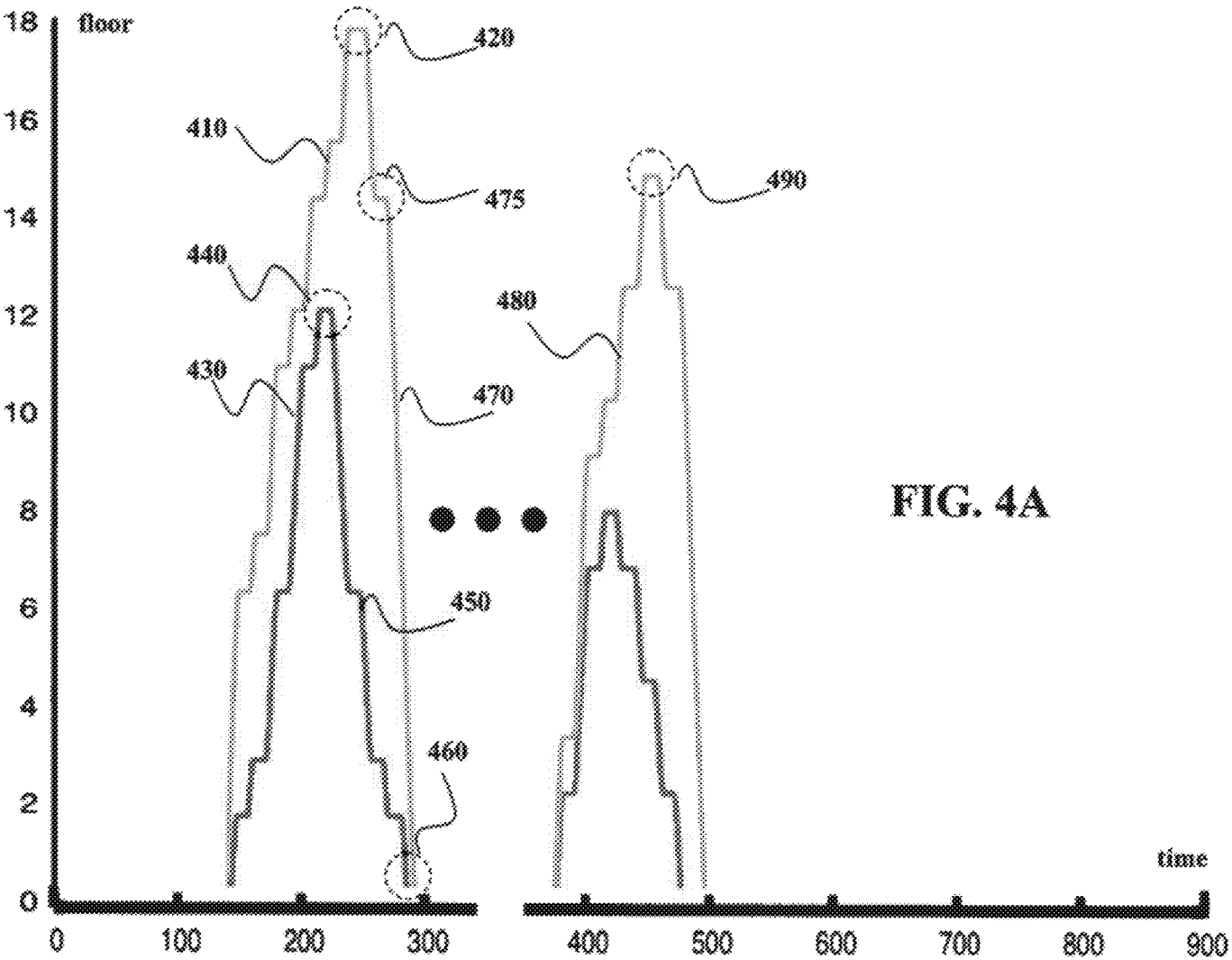
FIGS. 4A-B are graphs of motion plans of the elevator cars according to embodiments of the invention.

FIG. 4A graphically shows the motion plans for the first and the second car. A horizontal axis indicates time and a vertical axis indicates floors of the building. Horizontal segments of the graph indicate stops of the elevator cars. Elongated stops are waits forced by the motion constraints to prevent collisions.

For example, the first car is the lower elevator car and the second car is the upper elevator car, and a trajectory 410 of the second car from the lobby to a top floor 18 is the motion plan 350 known the method 300 for determining the motion plan of the first car. Also, for the illustration purposes, the home position of the car is the farthest position of the car according to the scheduled stops.

The motion plan for the second car is determined for the home position 420 of the second car. At this point, the motion period of the second car ends, and the motion period of the first car begins. The motion plan for the first car determines the scheduled of stops 430 until the schedule stop reaches a reversal position 440. The schedule of stops 430 considers the known motion plan of the second car and the deadlock invariants to prevent collisions of the elevator cars.

Because the reversal position 440 is not a home position of the first car, the motion period for the first car continues, and the schedule of stops 450 is determined. For the schedule of stops 450 there is no known motion plan of the second car. When the motion plan of the first car is determined until the home position 460 of the first car, the planning period of the first car ends, and the planning period of the second car begins. Accordingly, the second car plans its motion from the last scheduled position 420 until the home position 490. For example, the stop 475 can indicate the wait of the second car because of the known motion plan of the first car.

Figure 4B:
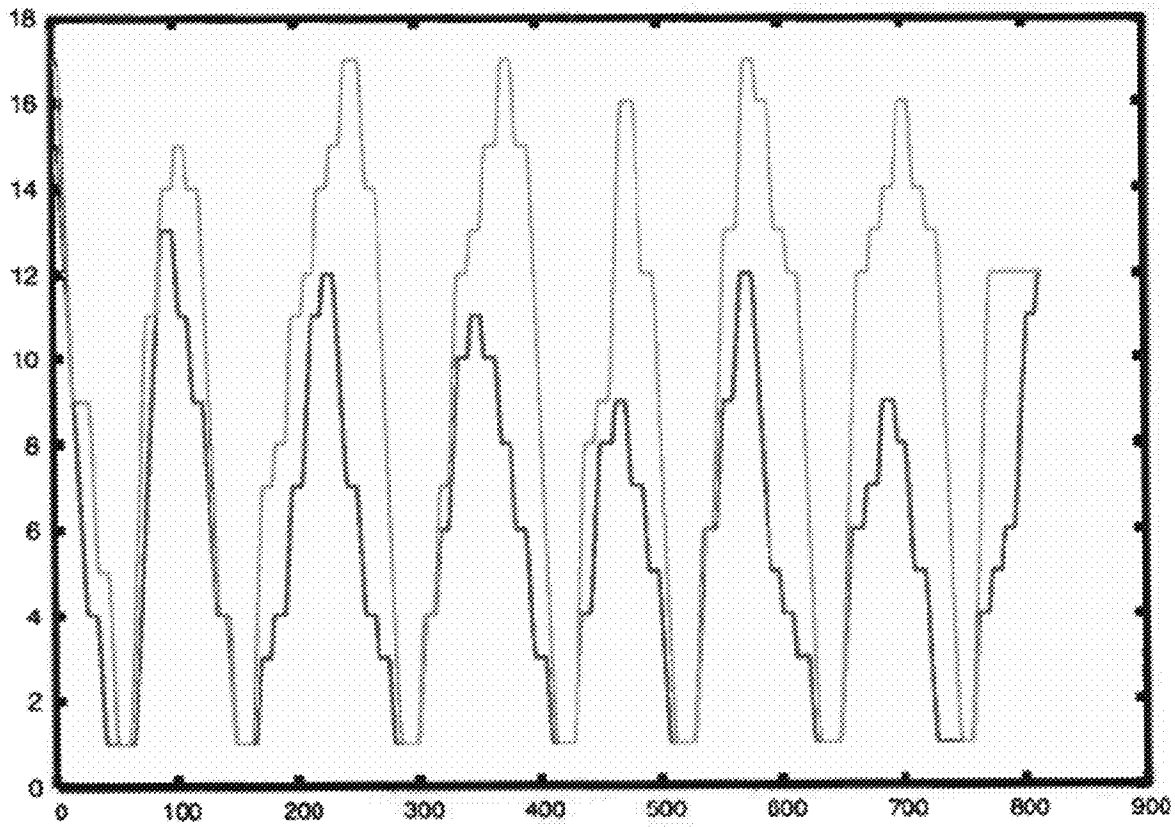

After the motion plan of the second car is determined until the home position 490, the next part of the motion plan of the first car starts is determined again. FIG. 4B shows motion plans of the first and the second cars as a function of floors and time.

Example of Motion Planning

Figure 6:
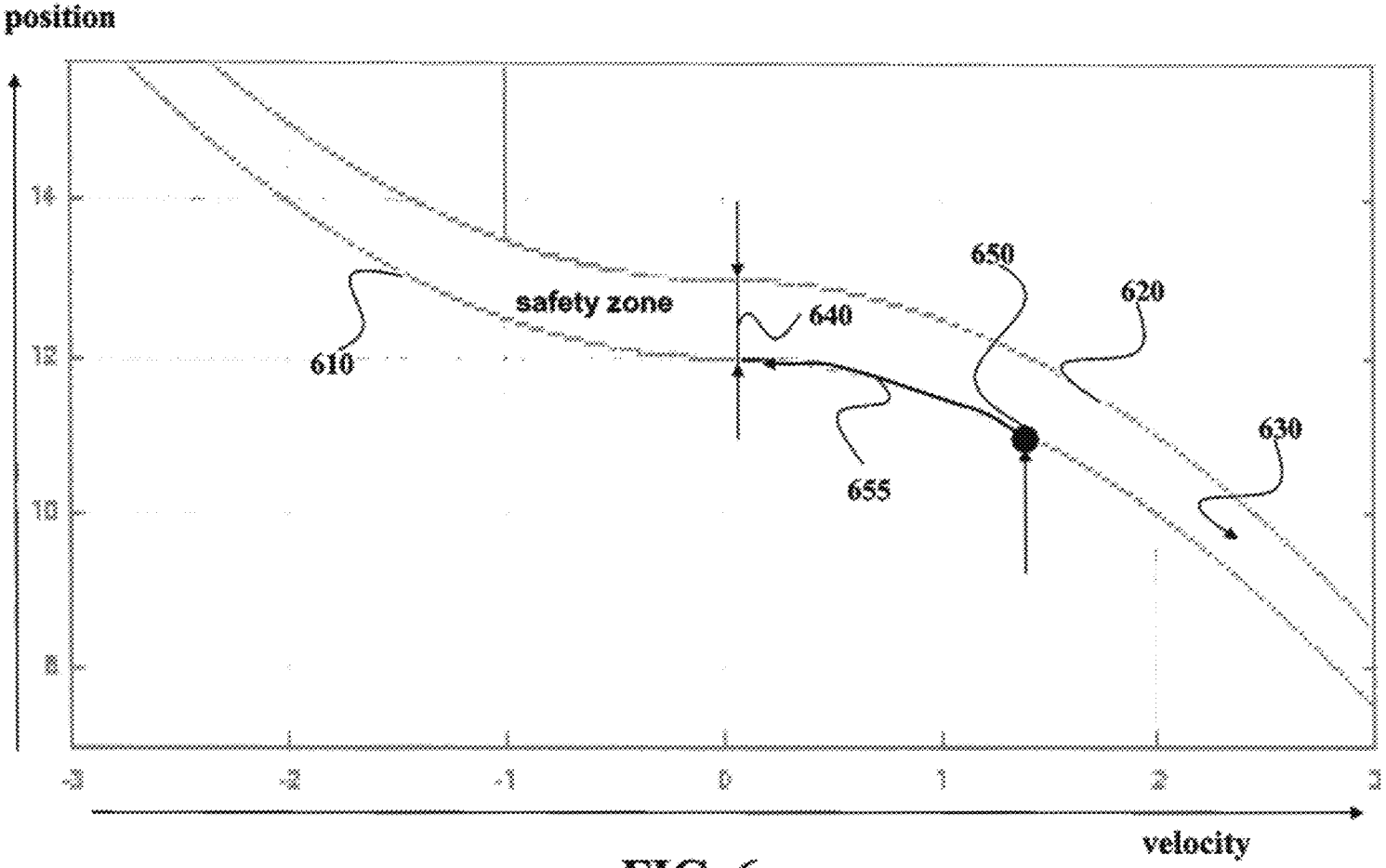
FIG. 6 is a graph showing a position and velocity diagram of multiple cars in one shaft according to embodiments of the invention.

FIG. 6 shows a pseudo-code of one embodiment of the invention. Until planning horizon is reached, the embodiment:

Select the first car as an elevator car whose motion plan ends first and which has yet-unserviced passengers assigned to the car.

Plan motion of the first car away from the home position with stops for passengers assigned to the car.

If the first car enters a deadlock zone of the second car wait at most recent stop of the first car until the scheduled motion of the second car eliminates the deadlock or collision risk.

If the other car is empty, change the motion plan of the second car, such that the second car is moved out of the way of the first car Plan the motion of the first car toward the home position with stops for passengers assigned to the car.

Stop planning for the first car at the home position, at which point the first car has emptied of passengers.

Announce that the motion until the home position is planed.

Optionally, collect statistics on system performance, e.g., passenger waits.

Repeat from step 1, wherein the second car is the first car

Accordingly, the embodiments of the invention determine the motion plans of the elevator cars alternately. Each car has a fair share of the planning time, and the motion plan for each car considers the motion plan of another car.

Collision Avoidance Module

Collision-avoidance methods are common in transportation and motion-control applications for objects that move, e.g., vehicles, and robots. Most of those methods are based on sensing, e.g., if sensed distances and/or velocities of the objects under control are unsafe, the method decelerates or stops the objects. Such systems require constant and reliable sensing that may not be cost-effective in the elevator systems. Additionally, the elevator systems have special constraints, i.e., deceleration of the elevator car must avoid passenger alarm. For the same reason, trapping passengers in a car between floors of a building should be avoided.

Some embodiments of the invention use a sensing-free method for controlling motion of the elevator car that guarantees safe and comfortable decelerations. If stops of the elevator cars are necessary for safety reasons, the method ensures that the elevator cars are stopped at floors where the doors can be opened. Each car has an independent motion plan, so sensing and communication are unnecessary.

FIG. 6 shows an example position-velocity graph of the elevator cars. The vertical axis indicates positions of the elevators cars in the shaft, e.g., floors. The horizontal axis indicates velocities of the elevator cars. For this example, the velocities of the elevator cars are positive for upward motion and negative for downward motion. A first deceleration curve 610 determines a relationship between a position and a velocity of the first car. A second deceleration curve 620 determines a relationship between a position and a velocity of the second car. The first and the second deceleration curves form a "safety zone" 630 between the curves 610 and 620.

The safety zone has a width equals or greater than a minimum distance d 640. The minimum distance between the elevator cars is maintained, by forcing the first car to decelerate, when the position and the velocity of the first car corresponds to a value on the first deceleration curve, and/or by forcing the second car to decelerate, when the position and the velocity of the second car corresponds to a value on the second deceleration curve. Typically, the minimum distance d is greater or equals a distance between consecutive floors.

The decelerations of the first and the second cars are performed such that the positions and the velocities of the first and the second cars according to the position-velocity graph do not cross the respective the first and the second deceleration curves. Typically, the deceleration of the first and the second cars are according to the respective deceleration curves. As define herein, a motion of an elevator car according to the deceleration curve is such that at any time during the motion, the elevator car has a position and a velocity corresponding to a value on the deceleration curve. Similarly, the deceleration of the elevator car according to the deceleration curve is the motion according to the deceleration curve such that the velocity is reduced.

For example, if the position and the velocity of the first car correspond to the value 650 on the first deceleration curve, the motion plan of the first car is changed such that the first car moves 655 according to the first deceleration curve.

In one embodiment, the first and the second deceleration curves are determined to facilitate the deceleration according to deceleration curve with a normal deceleration, i.e., similar to a standard rate of deceleration for a scheduled stop of the elevator car, see e.g., ISO 18738. For example, the deceleration curve is determined according to $$a\ \mathrm{sign}(\dot{x})\dot{x}^2/2,$$

wherein a is the conventional deceleration, and $\dot{X}$ is the velocity of the elevator car.

Figure 7:
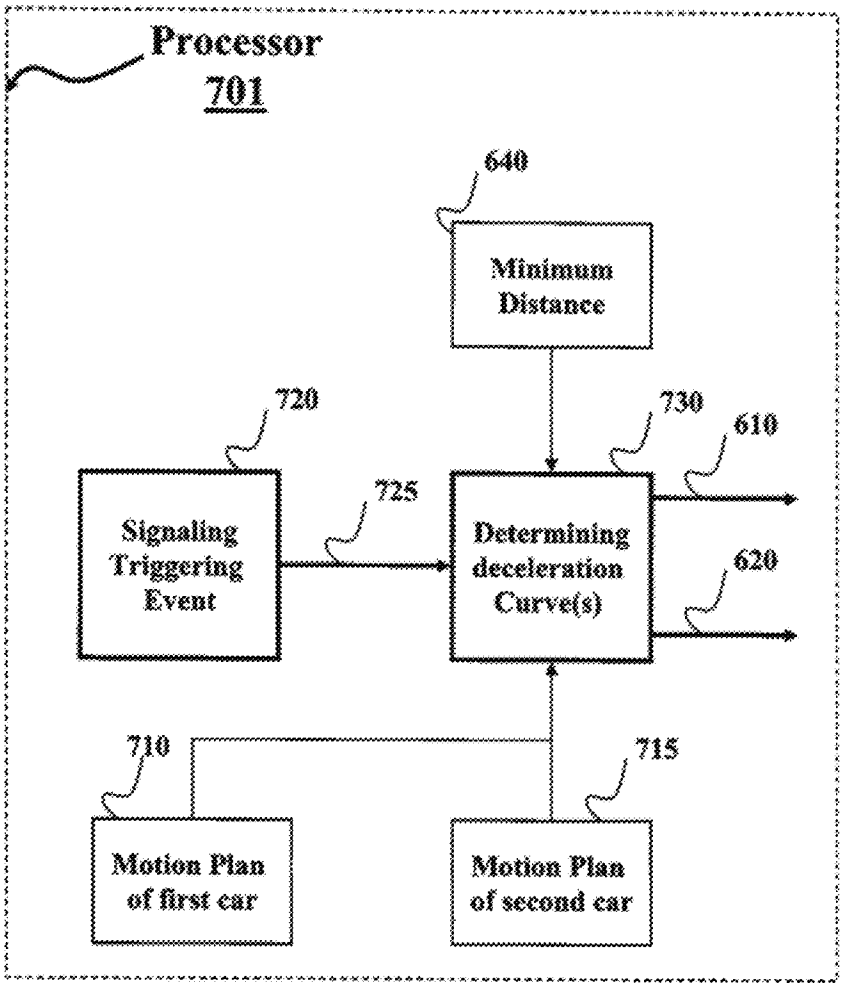
FIG. 7 is a flow diagram of a process for determining deceleration curves for cars in one shaft according to embodiments of the invention.

FIG. 7 shows a method 700 for determining 730 the first deceleration curve 610, the second deceleration curve 620, or both. The method can be performed in a processor 701. The method starts by signaling 720 a triggering event 725. The triggering event requires the deceleration curves to be determined 730. Examples of the triggering events are when the first or the second car accelerates from a stop, an update of the motion plans for either the first or the second car, the first and the second cars moves toward each other, or a distance between the first and the second cars is less than a predetermined threshold. Additionally or alternatively, the deceleration curves can be determined periodically.

In one embodiment, the first deceleration curve 610 and/or the second deceleration curve 620 are determined based on the motion plans 710 and 715 of the first and the second cars. For example, if the first car is expected to stop before the second car, the first deceleration curve is determined such the velocity of the first car according to the first deceleration curve is zero at the position corresponding to the scheduled stop of the first car. Similarly, the second deceleration curve is determined such the velocity of the second car according to the second deceleration curve is zero at the position corresponding to the scheduled stop of the second car.

Additionally or alternatively, the first and the deceleration curves are determined to maintain the minimum distance 640. In one embodiment, the minimum distance is predetermined. In alternative embodiment, the minimum distance is determined in correspondence with the velocities of the elevator cars.

Typically, the first and the second deceleration curves are determined such that the safety zone is between the elevator cars. However, when both elevator cars are moving in the same direction, in some situations the safety zone does not separate the cars. However, if a leading car moves at least as fast as a trailing car until either car begins decelerating for the next stop, then the embodiments of the invention maintain the minimum distance between the elevator cars.

Additionally, one embodiment integrates the motion plans of the leading car until one car starts decelerating to a stop, and immediately decelerates another car such that the minimum distance d is maintained.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

I claim:

1. A method for controlling a motion of a first car and a second car in a multi-car elevator system, wherein the first car and the second car move independently in an elevator shaft, comprising the steps of:

determining alternately motion plans for the first car and the second car wherein each part of a motion plan for the first car is determined for a planning period of the first car, wherein a beginning of the planning period of the first car is determined by an end of the planning period of the second car, and an end of the planning period of the first car is determined by a home position of the first car on the motion plan, wherein the part of the motion plan is determined based on motion constraints, a set of requests, and the motion plan of the second car determined by the beginning of the planning period of the first car; and generating a command to control the motion of the elevator cars based on the motion plans.

2. The method of claim 1, further comprising:

determining the beginning and the end of the planning periods of the first car and the second car, respectively.

3. The method of claim 1, further comprising:

determining the beginning of the planning period of the first car based upon receiving the motion plan of the second car.

4. The method of claim 1, further comprising:

determining alternately parts of the motion plans of the first car and the second car, wherein a part of the motion plan of the second car is a constraint in determining a part of the motion plan of a first car.

5. The method of claim 4, further comprising:

determining the parts of the motion plans from last schedule positions till the home positions of the elevator cars.

6. The method of claim 1, further comprising:

assigning the home positions for the first and the second elevator cars.

7. The method of claim 1, further comprising:

determining the home positions for the first car and the second car based on a respective farthest position of the cars.

8. The method of claim 1, further comprising:

determining the motion constraints for the motion plan of the first car based on the motion plan of the second car and a deadlock invariant.

9. The method of claim 1, wherein the deadlock invariant defines that the first car is outside of a deadlock zone of the second car.

10. The method of claim 1, wherein the deadlock invariant defines that the first car is within a deadlock zone of the second car, if the second car is empty, or the cars are planed to move in a same direction.

11. A method for controlling a motion of elevator cars in a multi-car elevator system, the elevators cars includes a first car and a second car, wherein the elevator cars move independently in an elevator shaft, comprising the steps of:

determining, upon receiving a motion plan of the second car until a home position of the second car, a part of a motion plan of the first car from a last scheduled position of the first car till a home position of the first car, wherein the determining is based on motion constraints, a set of requests, and the motion plan of the second car; and generating a command to control the motion of the first car based on the motion plan of the first car.

12. The method of claim 11, further comprising:

determining alternately a part of the motion plan of the second car, wherein the motion plan of the first car is a motion constraint in determining the part of the motion plan of the second car.

13. The method of claim 11, further comprising:

assigning the home positions for the first and the second elevator cars.

14. The method of claim 11, further comprising:

determining the home positions for the first and the second elevator cars based on a respective farthest position of the elevator cars.

15. A control system for controlling an operation of a multi-cars elevator system, wherein a first car and a second car move independently in an elevator shaft of the elevator system, comprising:

a first planning period module for determining a planning period for the first car;

a second planning period module for determining a planning period for the second car;

a first motion planning module for determining a motion plan for the planning period of the first car;

a second motion planning module for determining a motion plan for the planning period of the second car, wherein a beginning of the planning period of respectively the first car and the second car is determined by an end of the planning period of respectively the second car and the first car, and an end of the planning period of respectively the first car and the second car is determined by a home position of respectively the first car and the second car on respective motion plans, wherein the respective motion plans are determined based on motion constraints, a set of requests, and the motion plans determined before the planning period of the first car and the planning period of the second car; and an operation control module for generating a command to control motion of the first car and the second car based on the respective motion plans.

16. The control system of claim 15, further comprising:

a constraints module for determining the motion constraints for the motion plan of the first car based on the motion plan of the second car and a deadlock invariant, and for determining the motion constraints for the motion plan of the second car based on the motion plan of the first car and the deadlock invariant.

17. The control system of claim 15, further comprising:

a collision avoidance module for maintaining a minimum distance between the first car and the second car, the collision avoidance module comprising:

means for generating a command to move the first car according to a first deceleration curve, if a relationship between a position and a velocity of the first car corresponds to a value on the first deceleration curve; and means for generating a command to move the second car according to a second deceleration curve, if a relationship between position and a velocity of the second car corresponds to a value on the second deceleration curve, wherein a distance between the first and the second deceleration curve is equals or greater than a minimum distance.

18. The control system of claim 17, the collision avoidance module further comprising:

means for determining the first deceleration curve and the second deceleration curve based on a standard rate of deceleration for respectively the first and the second car.

19. The control system of claim 17, the collision avoidance module further comprising:

means for determining the first and the second deceleration curves in response to a triggering event.

20. The control system of claim 19, wherein the triggering event is selected from the group consisting of: the first or the second car accelerates from a stop, a motion plan for the first or the second car is updated, the first and the second cars move toward each other, and a distance between the first and the second cars is less than a predetermined threshold.

* * * * *